United States Patent [19]

Berto

[11] Patent Number: 4,951,886

[45] Date of Patent: Aug. 28, 1990

[54] CONCRETE CRUSHER

[75] Inventor: Michel Berto, Langoiran, France

[73] Assignee: Societe AMECA, Artigues, France

[21] Appl. No.: 414,249

[22] Filed: Sep. 29, 1989

[30] Foreign Application Priority Data

Sep. 30, 1988 [FR] France ..... 88 12994

[51] Int. Cl.[5] ..... B02C 1/06

[52] U.S. Cl. ..... 241/101.7; 225/103; 225/23; 241/300; 414/734

[58] Field of Search ..... 241/101.7, 263–269, 241/283, 300; 225/23 R, 103; 299/14, 15, 69, 70; 414/729, 734, 735

[56] References Cited

U.S. PATENT DOCUMENTS 2,044,624 6/1936 Morgan .
4,196,862 4/1980 Tagawa ..... 241/101.7 X
4,512,524 4/1985 Shigemizu ..... 241/101.7
4,719,975 1/1988 LaBounty .
4,776,524 10/1988 Sakato ..... 241/101.7
4,838,493 6/1989 LaBounty ..... 241/101.7

FOREIGN PATENT DOCUMENTS 2722258 11/1978 Fed. Rep. of Germany .
8704655 9/1987 Fed. Rep. of Germany .
2071053 3/1981 United Kingdom .

*Primary Examiner*—Timothy V. Eley
*Attorney, Agent, or Firm*—Foley & Lardner, Schwartz, Jeffery, Schwaab, Mack, Blumenthal & Evans

[57] ABSTRACT

A concrete crusher of the type comprising a rotatably mounted frame carrying both the crusher forming members and the shearing members, and wherein said shearing members are formed by at least one fixed arm and one of the arms of the crusher, the latter arm being articulated to said frame and adapted so as to give to the shears the maximum opening when it is in a maximum closed position of the crusher.

10 Claims, 5 Drawing Sheets

CONCRETE CRUSHER

BACKGROUND OF THE INVENTION

1. Field of the Invention

The present invention relates to a concrete crusher.

2. Brief Description of the Related Art

This type of tool is used for demolishing reinforced concrete structures and is generally mounted at the end of the jib of a hydraulic shovel in the place of a bucket.

These devices are generally formed by a jaw with two arms. Each arm has teeth. The jaw is articulated to a frame that is itself mounted for rotation. Shears are arranged between the arms and adapted for sectioning bars and other metal reinforcements.

Such systems, particularly the shears, are impractical in use and inefficient. In fact, the shears are situated at the bottom of the jaw in the immediate vicinity of one of the arms of the jaw which forms one of the two sectioning members of shears.

This arrangement has different drawbacks.

The introduction of bars to be sectioned inside the shears is difficult because the shears are located at the bottom of the crusher, in a position which is very difficult to see from the control cabin of the machine. Additionally, the opening of the shears is very small so that it is necessary most of the time to work blind and to grope around for the bars. It is often necessary to begin again several times in order to section a bundle of bars. Finally, the maximum opening of the shears is obtained by the maximum opening of the crusher. This may raise serious problems when bars have to be sectioned in restricted or encumbered spaces, or spaces of narrow access.

OBJECTS AND SUMMARY OF THE INVENTION

The aim of the present invention is to overcome these different drawbacks by providing another combination of means providing both the function of a concrete crusher and of the shears, in a more practical and efficient manner.

To achieve this goal the invention provides a concrete crusher, with a frame mounted for rotation that carries both the crusher forming members and the shearing members. The members are formed by at least one fixed arm and one of the arms of the crusher. The latter arm is articulated to the frame and adapted to give the shears their maximum opening when the crusher is in the maximum closed position.

The device is much easier to handle and is more efficient because the shears are at the end of the crusher and no longer at the bottom. The opening is much greater and corresponds to the minimum opening of the crusher, making it possible to shear cleanly and without groping, several grouped bars, in a single stroke after direct engagement.

The invention also improves the efficiency of the members of the shears and of the crusher by making it possible to easily adjust and/or replace the blades or teeth.

BRIEF DESCRIPTION OF THE DRAWINGS

Other features and advantages will be more fully understood when considered in conjunction with the accompanying drawings, in which.

DETAILED DESCRIPTION OF THE PREFERRED EMBODIMENT

Figure 1:
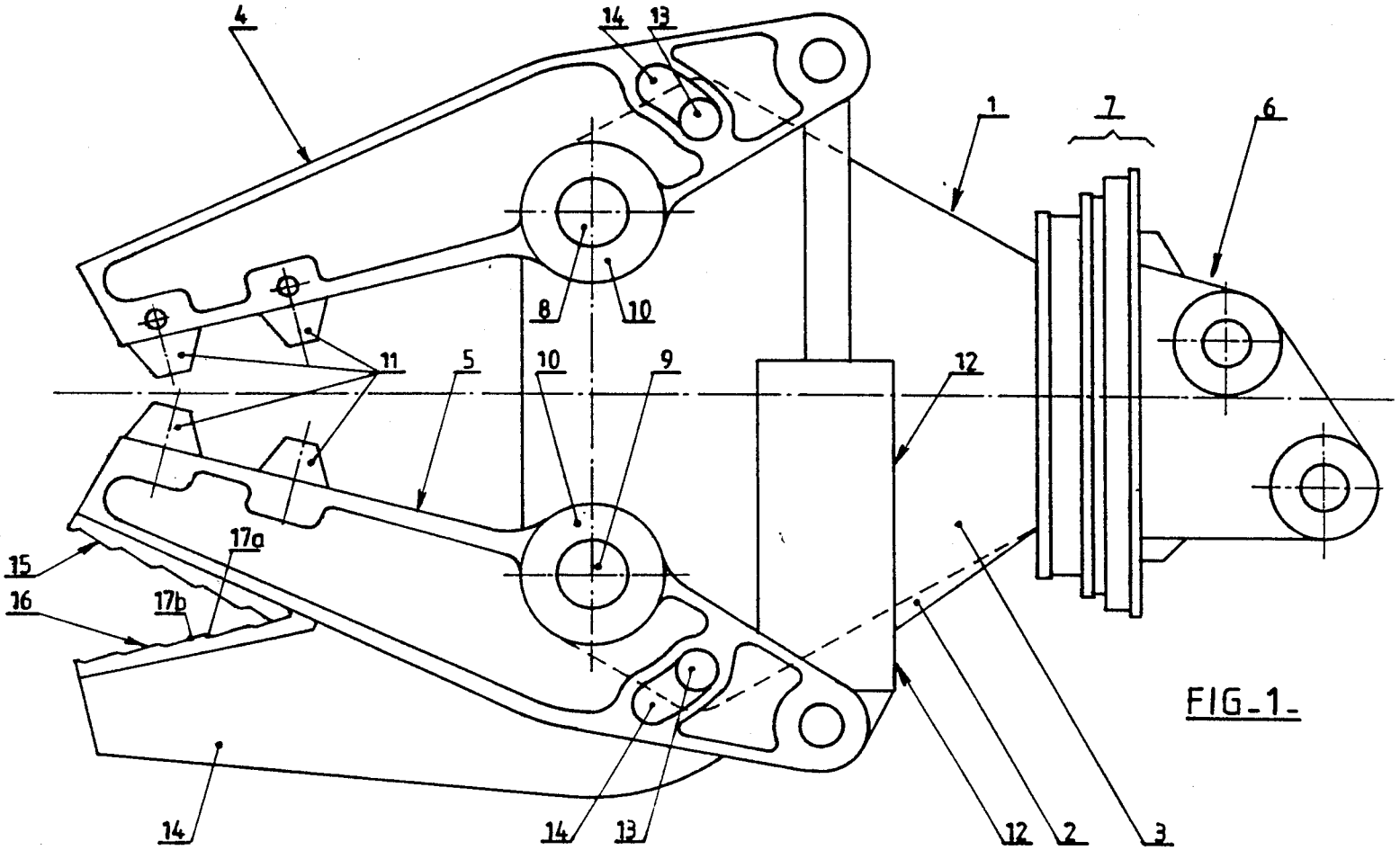
FIG. 1 shows, schematically, a side elevational view of a crusher in a first embodiment, the crusher being in the maximum closed position.
Figure 2:
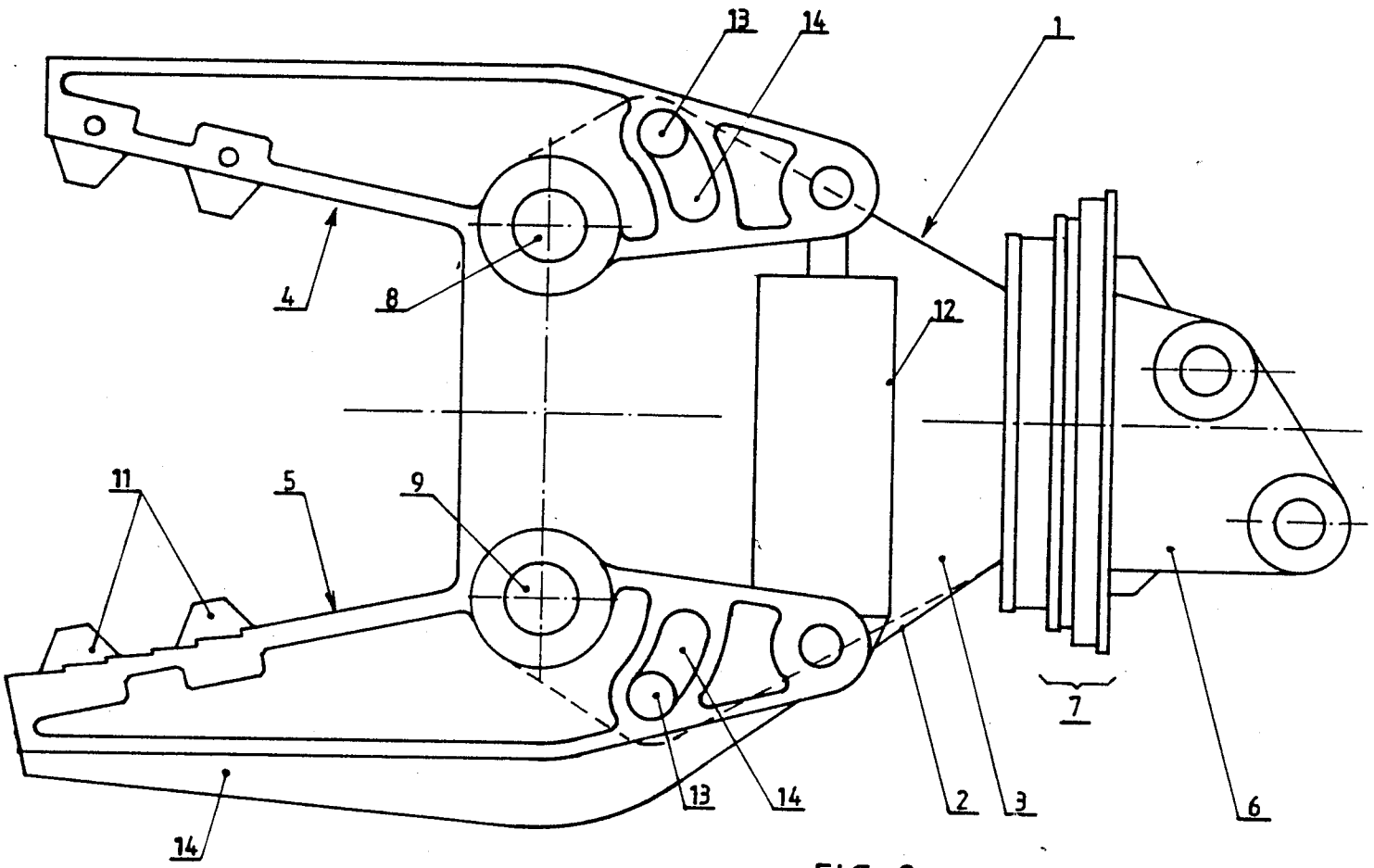
FIG. 2 illustrates the device of FIG. 1 in the maximum open position of the crusher.
Figure 3:
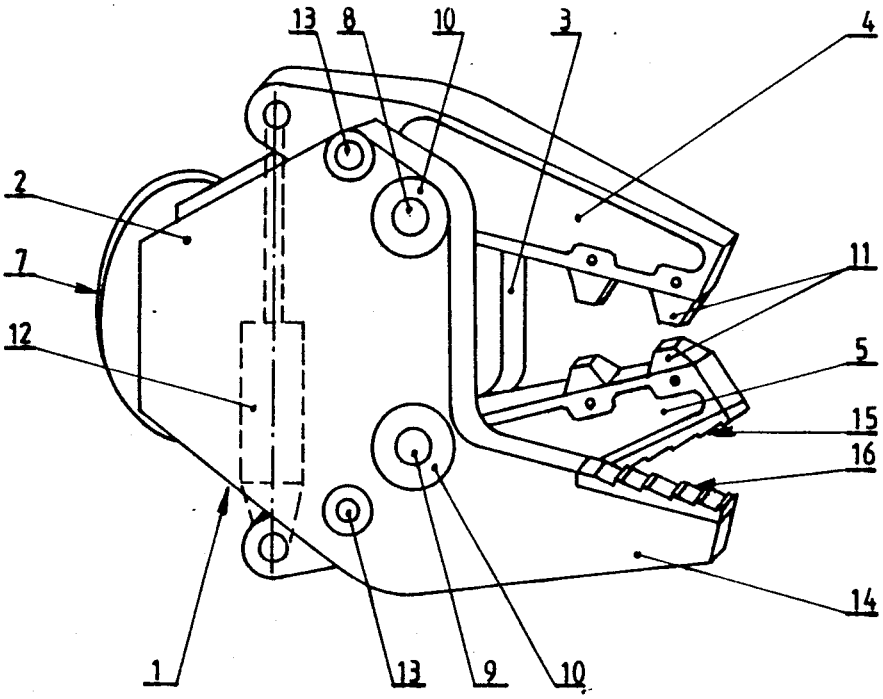
FIG. 3 is a perspective view of the crusher of FIG. 1.

The concrete crusher illustrated in FIGS. 1 to 3 has a frame 1 formed by two flanges 2 and 3 on and between which are articulated two concrete arms 4 and 5.

The assembly 1–5 is mounted for infinite rotation, by means of a hydraulic motor and rotary seal, on an adapter part 6 of conventional design. The assembly is intended to be mounted in a known way for example, at the end of the jib of a mechanical shovel. The rotation device with its fixed ball ring 7 is inserted between part 6 and frame 1 for; hydraulic regulation withstanding inopportune forces on the rotation control assembly.

Arms 4 and 5 form levers are flanked by journals 8 and 9 which are engaged in bearing 10 formed in the two flanges 2 and 3.

One of the ends of arms 4 and 5, on the inner side, has removably mounted teeth 11. Between the other ends of the arms is a hydraulic double-acting jack 12 inserted between flanges 2 and 3.

The angular movement of arms 4 and 5 is limited by a stop 13 on frame 1. An arcuate aperture 14 is formed in each arm in which the stop 13 may slide.

One of the flanges (2) has on one side, an extension in the form of an arm 14. The end of the arm (14) forms one of the arms of the shears. The other arm is formed by arm 5 of the crusher.

The active members of the shears are formed by cutting blades 15 and 16 which are removably mounted on the facing sides of arms 5 and 14 respectively.

The arrangement of arm 14 is such that, in the maximum closed position of the crusher 4,5, as illustrated in FIGS. 1 and 3, the opening of the shears 5,14 is maximum and in the maximum open position of the crusher (FIG. 2), the shears are completely closed. The blades 15 and 16 are disposed at the ends of arms 5 and 14 so it is possible to seize the bars with the largest possible opening. A greater ease of access and for gripping the bars is also provided.

Figure 7:
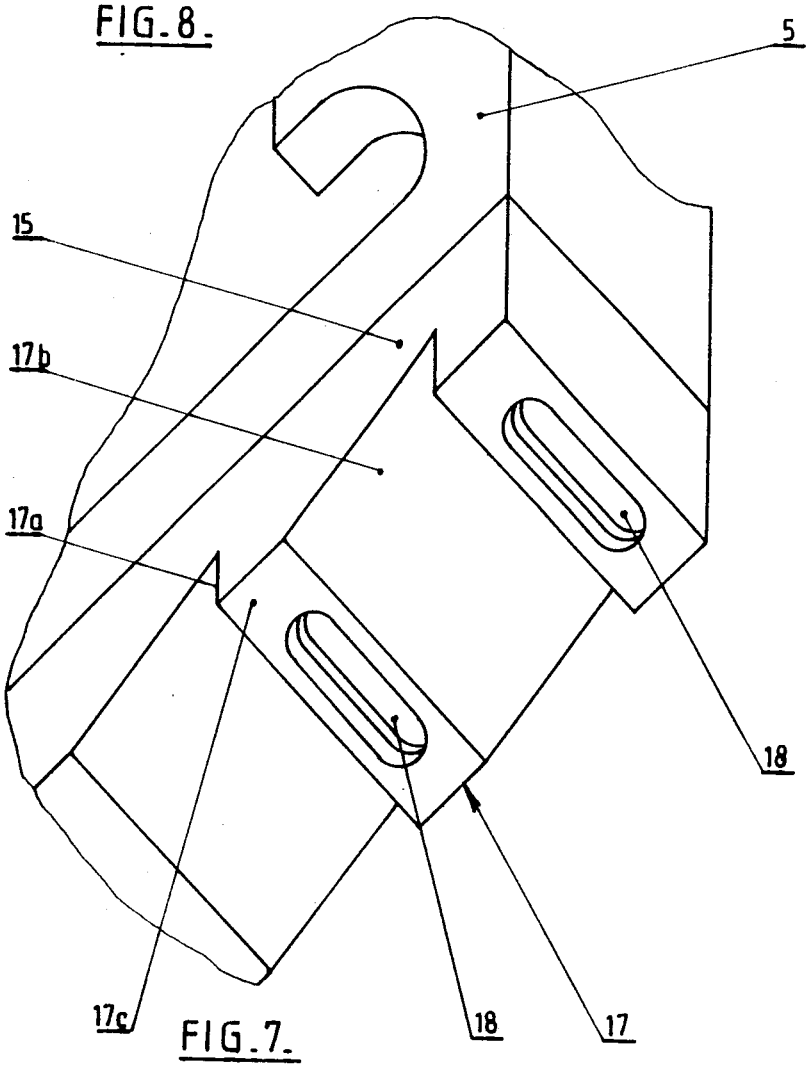
FIG. 7 illustrates the profile and the fitting of the cutting blades of the shears.

FIG. 7 illustrates the shape and mounting of blades 15 and 16. They are formed of an elongated plate having on one of its faces a series of teeth 17 whose asymmetric profile help retain the bars in the shears and prevent them from sliding out on closure of arms 5,14. This makes it possible to section the bars efficiently, either one at a time or in groups. Each tooth 17 comprises a side 17A which is substantially vertical with respect to the general plane of the blade plate, a side 17B which is slightly slanted in the outward direction of the shears and a chamfer 17C connecting the two sides 17A and 17B, avoiding any sharp and fragile edge at the end of the teeth.

The removable mounting of blades 15 and 16 makes it possible to sharpen the cutting edge by grinding one of the lateral sides of the blades.

The lateral adjustment of blades 15 and 16 on arms 5, 14 is possible through elongated bores 18 formed in the blades and in which fixing bolts are engaged.

Figure 8:
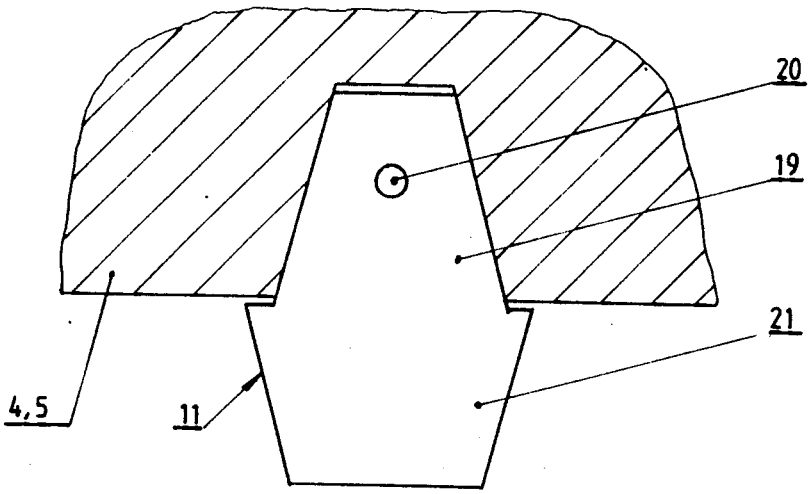
FIG. 8 illustrates the arrangements of the teeth of the concrete crusher.

The teeth 11 of the concrete crusher are preferably formed in parts (FIG. 8). A truncated cone shaped anchorage foot 19 engaged in a housing of corresponding shape formed in the receiving arm 4,5. The foot is retained in position by a pin 20. This mounting makes it possible to transfer to the truncated cone shaped housing all the forces exerted on tooth 11 whose external portion 21 is slightly withdrawn from the facing face of the carrier arm.

The removable character of teeth 11 and blades 15,16 makes it possible to replace damaged parts and to substitute, for present parts, parts having characteristics (shape, nature of the material) better adapted to the work contemplated. At the present time, such substitution is not possible, especially with the teeth of known concrete crushers, which are formed of weld deposits superimposed on the arms of the crusher. These teeth have to be further periodically regenerated because of wear.

It should be noted that with the present invention, when the concrete crusher 4,5 has completely broken, for example, a reinforced concrete beam, it is then in the completely closed position (FIG. 1), and the shears 5,14 are in the maximum open position, so it is immediately ready to grip and section the reinforcing bars. On the contrary, with known crushers, it is necessary to open the crusher completely since the shears are situated at the bottom. Similarly, at the end of shearing, the crusher is in the maximum open position therefore ready to act.

It should also be noted that in the crusher of the present invention, the bottom of the crusher (between teeth 11 and frame 1) is unrestricted, unlike known devices, and facilitates the gripping and work of the crusher.

The end of travel stops 13,14 are necessary because arms 4,5 are free to rotate. In their endmost open and closed positions, the arms 4,5 are symmetrical with respect to the axis of the crusher and so that the shears carry out their work suitably.

Figure 4:
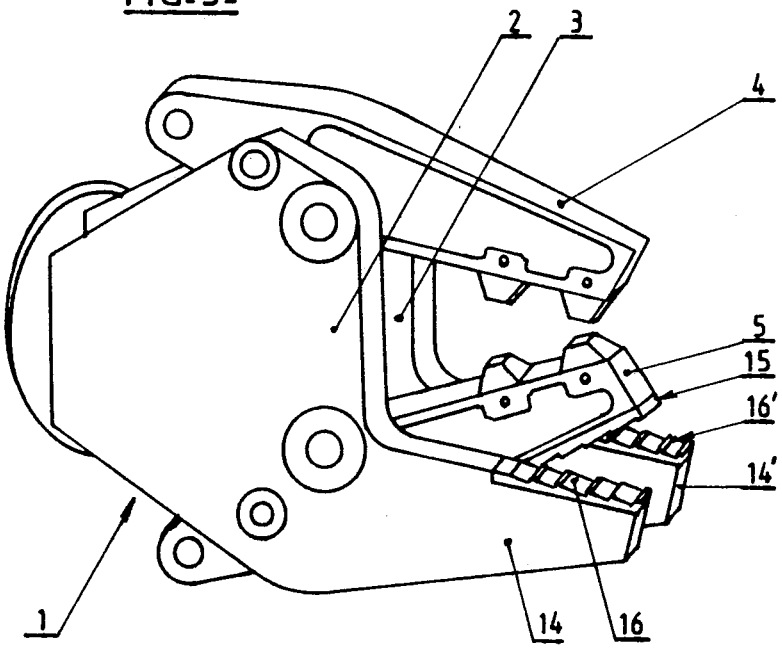
FIG. 4 is a perspective view of a variant in which the shears comprise two fixed paired arms and a mobile arm.

FIG. 4 illustrates a variant of the device of FIG. 3. A second arm 14', parallel to arm 14, is provided by means of an extension of flange 3. This arm 14' is provided with a cutting blade 16' parallel to blade 16. Arm 5 of the crusher moves between the two fixed arms 14,14'.

Figure 5:
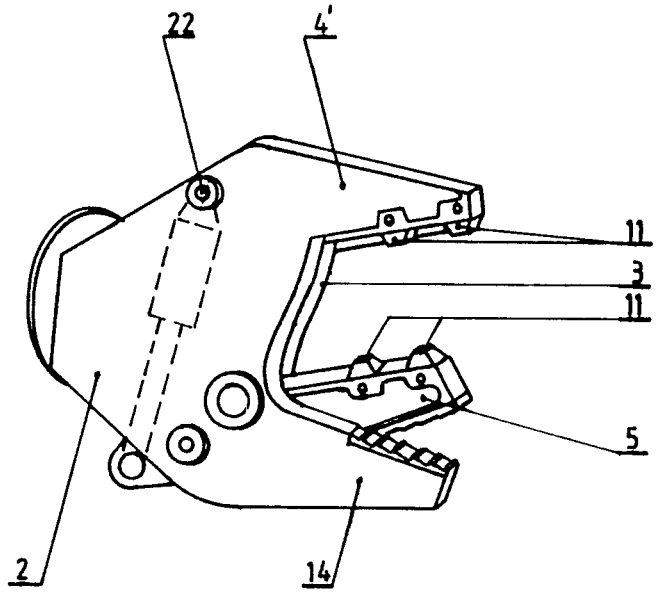
FIG. 5 is a perspective view of another embodiment in which the crusher and the shears have a single mobile arm which is common.

In the embodiment of FIG. 5, the concrete crusher has a mobile arm 5 that also forms one of the elements of the shears, as in the embodiment of FIG. 3. However, arm 5 also cooperates with a fixed and no longer mobile arm 4', and is formed from an extension of the two flanges 2 and 3.

The jack 12 controlling arm 5 is anchored at 22 on frame 1.

Figure 6:
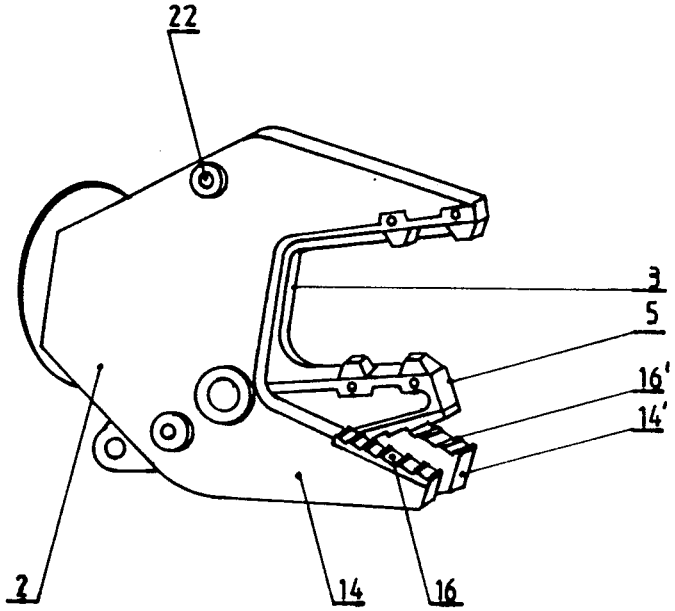
FIG. 6 shows, also in a perspective view, a variant of the device of FIG. 5 in which the shears comprise two fixed paired arms.

Finally, FIG. 6 illustrates a variant of the device of FIG. 5. The fixed arm 14 of the shears is paired with a second fixed arm 14', as in the embodiment of FIG. 4, giving frame 1 thus having a general U shape.

I claim:

1. Concrete crusher comprising:
   - a frame formed by a pair of flanges, the frame being rotationable;
   - a crushing member formed by a pair of crushing arms mounted on the frame; and
   - a shearing member formed by a fixed arm and one of the pair of crushing arms wherein a maximum closed position of the crushing member corresponds to a maximum open position of the shearing member.

2. A concrete crusher according to claim 1, wherein the fixed arm is formed by an extension of one of the flanges.

3. A concrete crusher according to claim 1, wherein the crushing arms are articulated to the frame.

4. A concrete crusher according to claim 1, wherein the two crushing arms form levers, each lever being provided with crushing teeth at one end and connected together at opposite ends by a double-acting hydraulic jack, the levers being mounted for free rotation on the frame and provided with a plurality of stop members limiting the angular movement of levers.

5. Concrete crusher according to claim 1, wherein the fixed arm is paired with a second fixed arm parallel to the first fixed arm, the second arm providing concrete breaking and shearing functions and being removably mounted between the fixed arm and the first crushing arm.

6. Concrete crusher according to claim 1, wherein the other crushing arm is fixed.

7. Concrete crusher according to claim 6, wherein the other crushing arm is formed by an extension of one of the flanges.

8. Concrete crusher according to claim 6, wherein the fixed arm is paired with a second fixed arm, said second arm providing the concrete breaking and shearing functions being mounted movably between the two said arms.

9. Concrete crusher according to claim 1, wherein the shearing member has removable cutting blades, the blades being formed by plates with a plurality of teeth having an asymmetric profile and being mounted adjustably on the arms.

10. Concrete crusher according to claim 1, wherein the arms of the crusher have a plurality of teeth, each tooth having an anchorage foot and being retained by a pin in a housing in the arm of an appropriate shape to receive the foot and capable of withstanding all forces exerted on each tooth.

* * * * *